United States Patent [19]

Stern et al.

[11] Patent Number: 4,746,926

[45] Date of Patent: May 24, 1988

[54] PHASE SCAN ANTENNA

[75] Inventors: Richard A. Stern, Allenwood; Richard W. Babbitt, Fairhaven; John J. Borowick, Bricktown, all of N.J.

[73] Assignee: The United States of America as represented by the Secretary of the Army, Washington, D.C.

[21] Appl. No.: 913,806

[22] Filed: Sep. 29, 1986

[51] Int. Cl.[4] ..... H01Q 1/00

[52] U.S. Cl. ..... 343/787; 343/788; 343/771

[58] Field of Search ..... 343/787, 788, 771; 342/371, 372

[56] References Cited

U.S. PATENT DOCUMENTS

| | | | |
|---|---|---|---|
| 2,740,113 | 3/1956 | Hemphill | 343/787 |
| 3,855,597 | 12/1974 | Carlise | 343/787 |
| 4,691,208 | 9/1987 | Stern et al. | 343/785 |

*Primary Examiner*—William L. Sikes

*Assistant Examiner*—Hoanganh Le

*Attorney, Agent, or Firm*—Sheldon Kanars; Robert A. Maikis

[57] ABSTRACT

A phase scan antenna suitable for millimeter wave radar applications is provided comprising a four-sided ferrite rod having a series of electromagnetic energy emitting slots along one side of the rod. The remaining three rod sides are enclosed by a metal, channel-shaped member which is spaced from the rod by a plastic, channel-shaped substrate member, so that energy emitted from the rod side which is opposite from the slotted rod side will be reflected to pass out the slotted rod side, to thereby enhance the antenna beam produced by the slotted rod side. A magnetic biasing coil having serially-interconnected coil portions is helically wound about the metal channel-shaped member with the coil portions disposed between the slots in the first rod side to cause scanning of the antenna beam. The ferrite rod may be end fed by either dielectric waveguide sections or hollow, metallic waveguide sections.

6 Claims, 2 Drawing Sheets

PHASE SCAN ANTENNA

STATEMENT OF GOVERNMENT RIGHTS

The invention described herein may be manufactured, used and licensed by or for the Government for governmental purposes without the payment to me of any royalties thereon.

BACKGROUND OF THE INVENTION

1. Field of the Invention

This invention relates to antennas and more particularly to an improved electronic pulse scan antenna of the waveguide type which is especially suitable for use in radar applications in the gigahertz region of the frequency spectrum.

2. Description of the Prior Art

The development of small, compact radar systems for use in tanks, terminally guided weapons and remotely piloted vehicles has created a need for a low cost, compact electronic phase scan antenna of the waveguide type which is of small size and weight. The antenna beam should be swept or "steered" electronically to eliminate the need for bulky and cumbersome mechanical scanning systems. Since the antenna is frequently fed by either dielectric waveguide, which is compatable with dielectric-based, millimeter wave integrated circuits, or the older, conventional hollow matellic waveguide, the antenna should be suitable for use with both types of waveguides. Apart from the foregoing military uses, antennas of this type may be used with small radar systems for small boats and light aircraft where size and weight are also a problem.

An antenna which meets many of the foregoing requirements is shown and described in copending U.S. patent application Ser. No. 640,183 which was filed July 2, 1984 by Richard A. Stern and Richard W. Babitt, two of the inventors of the present application, and which was assigned to the assignee of the present application. This antenna comprises a ferrite rod having a longitudinally-extending series of longitudinally-spaced apart perturbations along a first side of the rod which are adapted to radiate electromagnetic wave energy when the ends of the rod are coupled to a source of such energy. The "perturbations" essentially create irregularities in the length of the rod and may take the form of small openings or narrow slots in the side of the rod. Such an antenna operates on the so called "leaky-wave" principle so that the energy radiated from each perturbation is radiated in a direction which is normal to the point of penetration of the perturbation in the rod side. The radiated energy, however, is also radiated from a second rod side which is oppositely-disposed with respect to the first rod side. The third and fourth sides of the ferrite rod are provided with thin metallic plates or shims which are separated from the adjacent rod side by a thin substrate member fabricated of a plastic having a low dielectric constant. Magnetic biasing means, such as a magnetizing coil which is helically disposed along the length of the ferrite rod and metallic plate assembly, for example, are provided to apply a magnetic field along the longitudinal axis of the rod. The magnetic field created by the biasing coil magnetizes the ferrite which causes a change in electrical length of the rod which in turn produces a reciprocal phase shift in the rod. Essentially, the metallic plates on the third and fourth sides of the rod suppress the Faraday rotation of the wave within the rod and cause the electromagnetic beams radiated from the first and second rod sides to be scanned or swept.

SUMMARY OF THE INVENTION

It is an object of this invention to provide an electronic phase scan antenna which is compact, light in weight and small in size.

It is a further object of this invention to provide an electronic phase scan antenna which is mechanically rugged and which is economical to manufacture and maintain.

It is a still further object of this invention to provide an electronic phase scan antenna having an antenna gain which is substantially greater than the antenna gain of the antenna shown and described in said copending patent application Ser. No. 640,183.

It is an additional object of this invention to provide an electronic phase scan antenna which may be used with radar systems having front ends designed in either dielectric waveguide or conventional, hollow metallic waveguide.

It is another object of this invention to provide an electronic phase scan antenna having a relatively simple mechanical structure which not only provides the required Faraday rotation suppression but also the aforementioned increase in antenna gain.

Briefly, the phase scan antenna of the invention comprises a ferrite rod having a longitudinally-extending series of longitudinally-spaced apart perturbations along a first side thereof, a substantially channel-shaped substrate member fabricated of a low loss material having a low dielectric constant and having the web and flange sides thereof extending the length of the rod, a substantially channel-shaped metal member having the web and flange sides thereof extending the length of the rod, and magnetic biasing means mounted on the metal member for producing a magnetic field in the rod along the longitudinal axis of the rod. The perturbations on the first rod side are adapted to radiate electromagnetic wave energy from both the first rod side and an oppositely-disposed second rod side when the ends of the rod are coupled to a source of such energy. The substrate member has the flange sides thereof mounted on third and fourth rod sides which are substantially perpendicular to the first and second rod sides and the web side thereof mounted on the second rod side. The metal member has the flange sides thereof abutting the flange sides of the substrate member and the web side thereof abutting the web side of the substrate member, so that the flange sides of the metal member suppress Faraday rotation of electromagnetic wave energy in the rod when a magnetic field is applied along the longitudinal axis of the rod to thereby cause scanning of the antenna and the web side of the metal member reflects electromagnetic wave energy radiated from the second rod side to enhance electromagnetic wave energy radiated from the first rod side to thereby increase the gain of the antenna.

Waveguide means are coupled to the ends of the rod for coupling the antenna to electromagnetic wave energy transmitter and receiver apparatus. The waveguide means may comprise first and second sections of rod-shaped, non-ferrite dielectric waveguide having a cross-sectional area which is substantially the same as the cross-sectional area of the ferrite rod and a dielectric constant which is nearly the same as the dielectric constant of the ferrite rod so that the ferrite rod forms an integral dielectric waveguide transmission line therewith. Alternatively, when the channel-shaped metal member comprises a first section of hollow, metallic waveguide having one of the side thereof removed, the waveguide means may comprise second and third sections of hollow, metallic waveguide coupled to opposite ends of the first section of hollow, metallic waveguide with the sides thereof aligned with the sides of the first section of hollow waveguide, so that the first section of hollow waveguide forms an integral hollow metallic waveguide transmission line therewith. Accordingly, the antenna of the invention may be used with both dielectric waveguide and conventional, hollow metallic waveguide.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
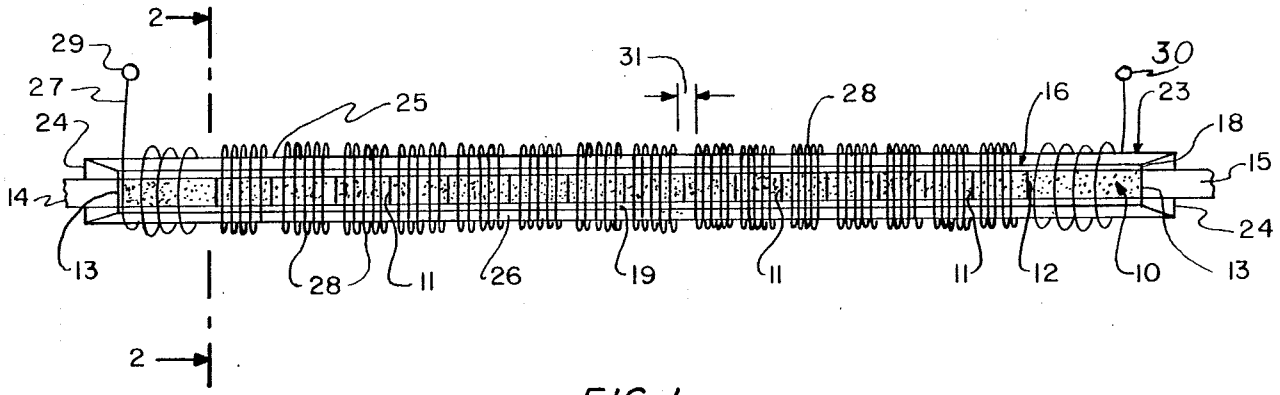
FIG. 1 is a front elevational view of the phase scan antenna of the invention.
Figure 2:
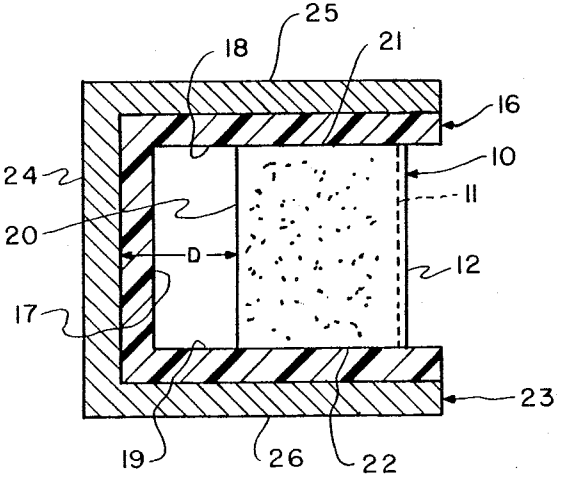
FIG. 2 is a full sectional view of the antenna of the invention taken along line 2—2 of FIG. 1 with the biasing coil omitted for convenience of illustration.

Referring now to FIGS. 1 and 2 of the drawings, there is shown a phase scan antenna constructed in accordance with the teachings of the present invention comprising a four-sided ferrite rod, indicated generally as 10, which has a longitudinally-extending series of longitudinally-spaced apart perturbations 11 along a first side 12 thereof. The perturbations 11 are narrow slots which are formed in the first rod side 12 and are oriented substantially perpendicular to the longitudinal axis of the rod. As explained previously, the perturbations may take other forms such as small depressions or openings in the rod. The ends 13 of the rod are coupled by waveguide means to electromagnetic wave energy transmitter and receiver apparatus, not shown, and to a load, not shown. The transmitter and receiver apparatus may be the front end of a millimeter wave radar system, for example. As seen in FIG. 1, the waveguide means may comprise first and second sections 14 and 15 of rod-shaped, non-ferrite dielectric waveguide which has a cross-sectional area which is substantially the same as the cross-sectional area of the ferrite rod. The dielectric constant of the waveguide sections 14 and 15 should be nearly the same as the dielectric constant of the ferrite rod 10. When the cross-sectional area of the dielectric waveguide sections 14 and 15 is aligned with the cross-sectional area of the ferrite rod and the ferrite rod is disposed between the first and second sections of dielectric waveguide, the rod forms an integral dielectric waveguide transmission line with the waveguide sections.

The antenna has a substantially channel-shaped substrate member, indicated generally as 16, which has a web side 17 and two flange sides 18 and 19, all of which extend the length of the ferrite rod 10. The web side 17 of the substrate member faces a second side 20 of the ferrite rod which is oppositely-disposed from the first rod side 12. Substrate member flange side 18 abuts a third rod side 21 while flange side 19 abuts a fourth rod side 22. The third and fourth rod sides 21 and 22 are perpendicular to the first and second rod sides 12 and 20 since the ferrite rod illustrated has a rectangular cross-sectional area.

The antenna also has a substantially channel-shaped metal member, indicated generally as 23, which has a web side 24 and two flange sides 25 and 26, all of which extend the length of the ferrite rod 10. The member 23 is fabricated of an electrically conductive metal and is so oriented with respect to the substrate member 16 that the web side 24 of the metal member abuts the web side 17 of the substrate member, the flange side 25 of the metal member abuts the flange side 18 of the substrate member and the flange side 26 of the metal member abuts the flange side 19 of the substrate member. As will be noted in FIG. 2 of the drawing, the web side 24 of the metal member 23 is spaced a predetermined distance D from the second rod side 20.

Magnetic biasing means are mounted on the metal member 23 to produce a magnetic field in the rod along the longitudinal axis of the rod to enable the antenna to be scanned. As seen in FIG. 1 of the drawings, the magnetic biasing means may comprise an elongated biasing coil, indicated generally as 27, which consists of a series of serially-interconnected biasing coils 28 which are helically wound about the metal member 23. The series of biasing coils are disposed along the length of the member 23. The ends of the biasing coil 27 are connected to terminals 29 and 30 which, in turn, are adapted to be connected to an antenna scanning control circuit, not shown. The individual coils 28 comprising biasing coil 27 are disposed along the length of the metal member 23 between the perturbations 11 on the first rod side 12 of the ferrite rod so that a space or "window" 31 is provided for each perturbation to prevent the biasing coils 28 from interferring with the electromagnetic wave energy radiated from the perturbations. In order to provide for fringing by the ferrite rod 10, the biasing coil 27 should be wound in such a manner that there is a gap of about 0.050 inches between the wire and the ferrite. When the wire used is 0.006 inches in diameter, each of the coils 28 may consist of five closely-wound turns, so that if the perturbations 11 are separated by a distance of 0.170 inches, the window opening 31 will be about 0.140 inches.

In practice, the ferrite rod 10 may be fabricated of a material having a saturation magnetization greater than 3000 and a dielectric loss tangent less than 0.005, such as nickel zinc or lithium zinc ferrite, for example. The non-ferrite, dielectric transmission line sections 14 and 15 may be fabricated of materials, such as magnesium titanate or alumina, for example, which have a loss tangent at microwave frequencies of less than 0.001 and a dielectric constant between about 9 and 38. Since the dielectric constant of the ferrite rod 10 is nearly the same as the dielectric constant of the transmission line sections 14 and 15, no impedance matching is necessary when joining the line sections to the rod. These elements may be joined by means of a low loss epoxy or an adhesive, such as Scotch-Weld Structural Adhesive, for example, which is marketed by the 3M Company of Saint Paul, Minn. The substrate member 16 may be fabricated of a low loss, low dielectric constant plastic, such as the thermoset, cross-linked styrene copolymer, "Rexolite 1422", which is marketed by the C-LEC Company of Beverly, N.J., for example. Finally, the metal member 23, which must be fabricated of a material which is a good electrical conductor, may be made of brass, aluminum or silver for example.

Figure 3:
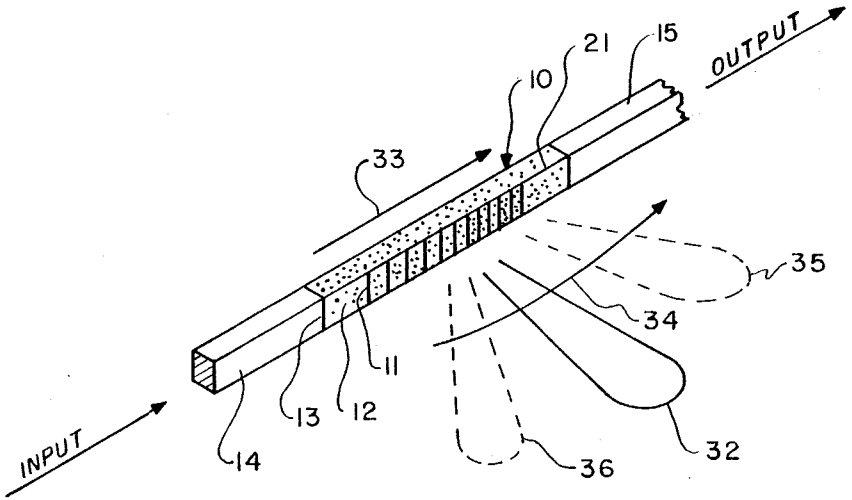
FIG. 3 is a perspective view of the ferrite rod portion of the antenna of the invention showing the antenna beam pattern produced and how that beam pattern is swept by the magnetic biasing field.

The operation of the antenna of the invention is best described with reference to FIG. 3 of the drawings. When the antenna has the dielectric waveguide section 14 coupled to a source of electromagnetic wave energy (not shown), such as the millimeter wave output of a radar front end, for example, and the waveguide section 15 coupled to a load (not shown), the antenna will produce a beam pattern 32 which is radiated from the perturbations 11 in the first rod side 12. As understood in the art, the shape of the beam is determined by the location and spacing of the perturbations 11. When the biasing coil 27 is energized, a magnetic field is produced in the rod along the longitudinal axis thereof as represented schematically by the arrow 33. The applied magnetic field tends to produce a Faraday rotation of the electromagnetic wave in the rod but the rotation is suppressed or prevented by the flange sides 25 and 26 of the metal member 23 which face the third and fourth rod sides 21 and 22, respectively. Again, as understood in the art, the suppressed rotation causes a sweeping of the antenna beam 32, as represented by the arrow 34, between the dotted line beam positions 36 and 35. Accordingly, by varying the current applied to the biasing coil 27, the beam may be swept through an angle which is determined by the design parameters of the antenna. The same antenna, of course, will also act to receive incoming electromagnetic wave energy, which in the case of a radar system, is the returning or "echo" signal. The antenna has a reciprocal phase shift action which permits the beam to sweep between positions 36 and 35 when the biasing coil is energized with current, regardless of the polarity of the current.

Figure 5:
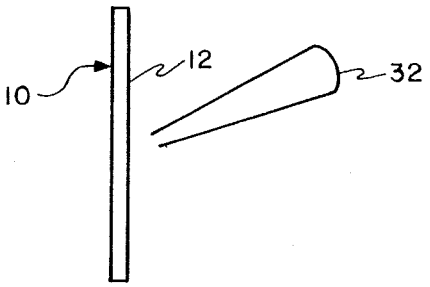
FIG. 5 is a schematic diagram showing the enhanced beam pattern produced by the antenna of the present invention.
Figure 4:
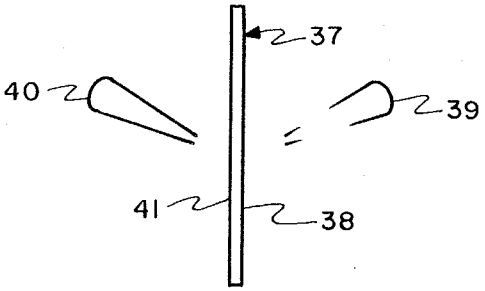
FIG. 4 is a schematic diagram showing the beam pattern produced by the antenna disclosed in said copending patent application Ser. No. 640,183.

The web side 24 of the metal member 23 which faces the second rod side 20 prevents a second beam from being radiated from the second rod side. As explained previously, the antenna disclosed in said copending patent application Ser. No. 640,183 has metal plates on the third and fourth rod sides only so that antenna beams are produced from both the first and second rod sides. This is shown schematically in FIG. 4 of the drawings wherein the ferrite rod antenna, indicated generally as 37, has a series of perturbations extending along the first rod side 38. As seen therein, the perturbations on rod side 38 not only produce a radiated beam 39 on the same side of the rod as the perturbations but also a beam 40 on the rod side 41 which is oppositely-disposed from the rod side 38. In the antenna of the present invention, however, the web side 24 of the metal member 23 prevents the beam from the second rod side 20 from being emitted and essentially reflects the beam so that it passes out the first rod side 12 where it enhances the electromagnetic wave energy radiated from the first rod side. This is shown in FIG. 5 of the drawings wherein the ferrite rod portion of the antenna of the invention is shown schematically as 10 and the enhanced beam pattern 32 is shown as being radiated only from the side 12 of the antenna rod containing the series of perturbations. For maximum enhancement of the radiated beam pattern 32, the distance D between the second rod side 20 and the web side 24 of the metal member shown in FIG. 2 of the drawings should be such that the electromagnetic wave energy reflected from the web side of the metal member is substantially in phase with the electromagnetic wave energy radiated from the first rod side. The exact distance, of course, will depend upon the wave length of the frequency at which the antenna is operated. From the foregoing description, it is believed apparent that the channel-shaped metal member 23 not only provides the required Faraday roation suppression but also the aforementioned increase in antenna gain.

Figure 7:
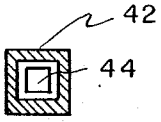
FIG. 7 is a full sectional view of the antenna of FIG. 6 taken along the line 7—7 of FIG. 6.
Figure 6:
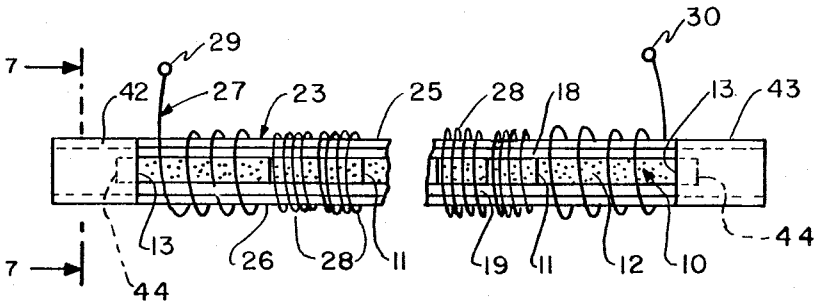
FIG. 6 is a front elevational view, which has been foreshortened for convenience of illustration, of the antenna of the present invention showing it coupled to sections of hollow, metallic waveguide.

In FIGS. 6 and 7 of the drawings, the antenna of the invention is shown in use with waveguide means comprising sections of conventional, hollow metallic waveguide. The channel-shaped metal member 23 may itself comprise a first section of hollow metallic waveguide having one of the sides thereof removed. Second and third sections of hollow metallic waveguide 42 and 43 are connected to opposite ends of the first section of hollow metallic waveguide 23. When the sides of the second and third waveguide sections are aligned with the sides of the first section of waveguide and the first section of waveguide is disposed between the second and third sections of waveguide, the first section of waveguide 23 forms an integral, hollow metallic waveguide transmission line with the second and third waveguide sections 42, 43. When conventional, hollow metallic waveguide is used, however, it is necessary to match the impedance of the ferrite rod to the impedance of the second and third hollow metallic waveguide sections 42, 43. This may be done, as is known in the art, by employing dielectric transformer means such as a block of dielectric material 44 which is mounted on each end 13 of the ferrite rod. The dielectric transformer block is fabricated of a low loss, dielectric material having a dielectric constant which is the square root of the dielectric constant of the ferrite rod material. Accordingly, it is seen that the antenna of the invention may be used with waveguide means comprising either sections of dielectric waveguide or sections of conventional, hollow metallic waveguide.

It is believed apparent that many changes could be made in the construction and described uses of the foregoing antenna and many seemingly different embodiments of the invention could be constructed without departing from the scope thereof. Accordingly, it is intended that all matter contained in the above description or shown in the accompaying drawings shall be interpreted as illustrative and not in a limiting sense.

What is claimed is:

1. A phase scan antenna comprising a ferrite rod having a longitudinally-extending series of longitudinally-spaced apart narrow slots along a first side thereof for radiating electromagnetic wave energy from both said first rod side and an oppositely-disposed second rod side when the ends of said rod are coupled to a source of said energy, each of said slots being substantially perpendicular to the longitudinal axis of said rod;

waveguide means coupled to the ends of said rod for coupling said rod to a source of electromagnetic wave energy to be radiated;

a channel-shaped substrate member fabricated of a low loss material having a low dielectric constant and having the web and flange sides thereof extending the length of said rod, said substrate member having the flange sides thereof mounted on third and fourth rod sides which are substantially perpendicular to said first and second rod sides and the web side thereof facing said second rod side;

a channel-shaped metal member having the web and flange sides thereof extending the length of said rod, said metal member having the flange sides thereof abutting the flange sides of said substrate member and the web side thereof abutting the web side of said substrate member; and magnetic biasing means mounted on said metal member for producing a magnetic field in said rod along said longitudinal axis, whereby said flange sides of said metal member suppress Faraday rotation of electromagnetic wave energy in said rod caused by said magnetic field to thereby cause scanning of the antenna and said web side of said metal member reflects electromagnetic wave energy radiated from said second rod side to thereby enhance electromagnetic wave energy radiated from said first rod side.

2. A phase scan antenna as claimed in claim 1 wherein said web side of said metal member is spaced a predetermined distance from said second rod side, and said predetermined distance is such that the electromagnetic wave energy reflected from said web side of said metal member is substantially in phase with the electromagnetic wave energy radiated from said first rod side.

3. A phase scan antenna as claimed in claim 2 wherein said magnetic biasing means comprises a series of serially-interconnected biasing coils helically wound about said metal member and extending along the length thereof, the biasing coils of said series of coils being disposed along the length of said metal member between the slots of said series of slots to prevent interference with the electromagnetic wave energy radiated from said series of slots.

4. A phase scan antenna as claimed in claim 3 wherein said rod has a rectangular cross-sectional area, and each of the web and flange sides of said metal member is substantially parallel to the respective rod side which it faces.

5. A phase scan antenna as claimed in claim 4 wherein said waveguide means comprises first and second sections of rod-saped non-ferrite dielectric waveguide having a cross-sectional area which is substantially the same as the cross-sectional area of said ferrite rod and a dielectric constant which is nearly the same as the dielectric constant of said ferrite rod, said first and second sections of dielectric waveguide being coupled to opposite ends of said ferrite rod with the cross-sectional area of said dielectric waveguide sections aligned with the cross-sectional area of said ferrite rod so that said ferrite rod is disposed between said first and second sections of dielectric waveguide and forms an intregral dielectric waveguide transmission line therewith.

6. A phase scan antenna as claimed in claim 4 wherein said channel-shaped metal member comprises a first section of hollow metallic waveguide having one of the sides thereof removed; and said waveguide means comprises second and third sections of hollow metallic waveguide coupled to opposite ends of said first section of hollow metallic waveguide with the sides thereof aligned with the sides of said first section of hollow waveguide so that said first section of hollow-waveguide is disposed between said second and third sections of hollow-waveguide and forms an intergral hollow metallic waveguide transmission line therewith, and dielectric transformer means mounted on each end of said ferrite rod for matching the impedance of said rod to the impedance of said second and third hollow metallic waveguide sections.

* * * * *